US007589479B2

(12) United States Patent
Kim

(10) Patent No.: US 7,589,479 B2
(45) Date of Patent: Sep. 15, 2009

(54) BACKLIGHT DRIVING APPARATUS OF LIQUID CRYSTAL DISPLAY AND METHOD FOR DRIVING BACKLIGHT DRIVING APPARATUS

(75) Inventor: Byoung Chul Kim, Gyeongsanbuk-do (KR)

(73) Assignee: LG Display Co., Ltd., Seoul (KR)

( * ) Notice: Subject to any disclaimer, the term of this patent is extended or adjusted under 35 U.S.C. 154(b) by 150 days.

(21) Appl. No.: 11/646,495

(22) Filed: Dec. 28, 2006

(65) Prior Publication Data

US 2007/0285029 A1 Dec. 13, 2007

(30) Foreign Application Priority Data

Jun. 7, 2006 (KR) ..... 10-2006-0050705

(51) Int. Cl.
*H05B 37/02* (2006.01)

(52) U.S. Cl. ..... 315/291; 345/102; 345/204

(58) Field of Classification Search ..... 315/287, 315/209 PZ, 276, 291, 299, 244, 245, 291.307, 315/361, 169.1–169.3; 345/77, 87, 102, 345/204

See application file for complete search history.

(56) References Cited

U.S. PATENT DOCUMENTS

| | | | | |
|---|---|---|---|---|
| 6,566,821 | B2 * | 5/2003 | Nakatsuka et al. | 315/209 PZ |
| 6,657,838 | B2 * | 12/2003 | Min | 361/91.1 |
| 7,358,685 | B2 * | 4/2008 | Lee | 315/287 |
| 7,456,819 | B2 * | 11/2008 | Lee et al. | 345/102 |
| 2006/0267863 | A1 * | 11/2006 | Kim | 345/51 |

* cited by examiner

*Primary Examiner*—Douglas W Owens
*Assistant Examiner*—Jimmy T Vu
(74) *Attorney, Agent, or Firm*—Holland & Knight LLP

(57) ABSTRACT

A backlight driving apparatus for a liquid crystal display device includes a light source, an AC driver for supplying a high voltage AC power to turn on the light source, and a protection circuit electrically connected to the AC driver responsive to an input voltage lower than a reference voltage for stopping the driving of the AC driver.

20 Claims, 6 Drawing Sheets

BACKLIGHT DRIVING APPARATUS OF LIQUID CRYSTAL DISPLAY AND METHOD FOR DRIVING BACKLIGHT DRIVING APPARATUS

This application claims the benefit of the Korean Patent Application No. 10-2006-0050705 filed in Korea on Jun. 7, 2006, which is hereby incorporated by reference in its entirety.

BACKGROUND

1. Field of the Invention

Embodiments of the present invention relate to a liquid crystal display device, and more particularly, to a backlight apparatus for a liquid crystal display device. Embodiments of the present invention are suitable for a wide scope of applications. In particular, embodiments of the present invention are suitable for driving a backlight apparatus for a liquid crystal display device.

2. Discussion of Related Art

Recently, the liquid crystal display (LCD) devices have been widely used in portable videos, cameras, TV, computer monitors, mobile phones, vehicle navigation devices, and so on. The LCD device is a light-receiving display device that displays an image on an LCD panel by controlling the amount of externally provided input light. Thus, the LCD device requires a backlight unit for irradiating light onto the liquid crystal display panel.

The backlight unit uses a lamp as a light source and converts light from the lamp into a surface light having the same luminance and irradiates the converted light onto the LCD panel. The backlight unit can be classified into a direct type and an edge type depending on the location of the lamp. In the direct type backlight unit, the lamp is at the rear of the LCD panel, and light is directly transmitted to the front of the LCD panel. In contrast, in the edge type backlight unit, the lamp is disposed to the side of the LCD panel, and light is reflected, diffused and condensed through a wave-guide plate, a reflection sheet and an optical sheet, to be transmitted from the side to the front of the LCD panel.

The lamp may be a cold cathode fluorescent lamp (CCFL), an external electrode fluorescent lamp (EEFL), and a light-emitting diode (LED), etc. The backlight unit must apply a driving voltage to the lamp to emit light. The driving voltage is applied by a driver (or an inverter) provided in the backlight unit.

FIG. 1 is a block diagram of a backlight driving apparatus for an LCD device according to the related art. Referring to FIG. 1, the related art backlight driving apparatus has a light source 1 that emits light, and a backlight (B/L) driver 2 for controlling the lighting of the light source 1. The backlight driver 2 converts an externally provided DC input voltage into an AC voltage, boosts the AC voltage to a predetermined level, and supplies the boosted AC voltage to the light source 1. The backlight driver 2 supplies a sufficiently high voltage to turn on the light source 1 and controls the current of the light source 1 after the light source 1 has been turned on to maintain a constant luminance, in accordance with the characteristic of the light source 1.

For example, the physical properties of the LCD device might change due to a variation in the ambient environment, or the backlight unit might be changed, or the input voltage might fluctuate due to the instability of the input power. Then, the backlight driver 2 controls the current to provide a constant power to the light source 1. In particular, when the input voltage is low, the consumed current is high, and when the input voltage is high, the consumed current is low. However, if the input voltage is low and a high current is consumed, an excessive load is applied to the external power supply unit and the backlight driver 2 due to the excess current. Accordingly, the internal circuit of the backlight could be damaged causing the operation of backlight driver 2 to be unstable.

SUMMARY OF THE INVENTION

Accordingly, the present invention is directed to a backlight driving apparatus for a liquid crystal display device and a method of driving the backlight driving apparatus, which substantially obviate one or more problems due to limitations and disadvantages of the related art.

An object of the present invention to provide a backlight driving apparatus of a liquid crystal display that can protect a backlight driver from an excess current generated due to variations in an input voltage applied thereto.

Another object of the present invention to provide a method of driving a backlight driving apparatus of a liquid crystal display that can protect a backlight driver from an excess current generated due to variations in an input voltage applied thereto.

Additional features and advantages of the invention will be set forth in the description of exemplary embodiments which follows, and in part will be apparent from the description of the exemplary embodiments, or may be learned by practice of the exemplary embodiments of the invention. These and other advantages of the invention will be realized and attained by the structure particularly pointed out in the written description of the exemplary embodiments and claims hereof as well as the appended drawings.

To achieve these and other advantages and in accordance with the purpose of the present invention, as embodied and broadly described, a backlight driving apparatus for a liquid crystal display device includes a light source, an AC driver for supplying a high voltage AC power to turn on the light source, and a protection circuit electrically connected to the AC driver responsive to an input voltage lower than a reference voltage for stopping the driving of the AC driver.

In another aspect, a backlight driving apparatus for a liquid crystal display includes a light-emitting diode, a DC driver for supplying a high voltage DC power to turn on the light-emitting diode, and a protection circuit electrically connected to the DC driver responsive to an input voltage lower than a reference voltage for stopping the driving of the DC driver.

In another aspect, a method for driving a backlight driving apparatus of a liquid crystal display includes providing an input voltage to a driver for supplying a high voltage driving power to a light source, setting a reference voltage with a zener diode, dividing the input voltage to form a comparison voltage, comparing the comparison voltage and the reference voltage, and driving or shutting down the driver by outputting a control voltage to control the operation of the driver after the comparison step.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the present invention and are incorporated in and constitute a part of this application, illustrate embodiments of the present invention and together with the description serve to explain the principle of embodiments of the present invention. In the drawings.

DETAILED DESCRIPTION OF EXEMPLARY EMBODIMENTS

Reference will now be made in detail to exemplary embodiments of the present invention, which are illustrated in the accompanying drawings. Wherever possible, the same reference numbers will be used throughout the drawings to refer to the same or like parts.

Figure 1:
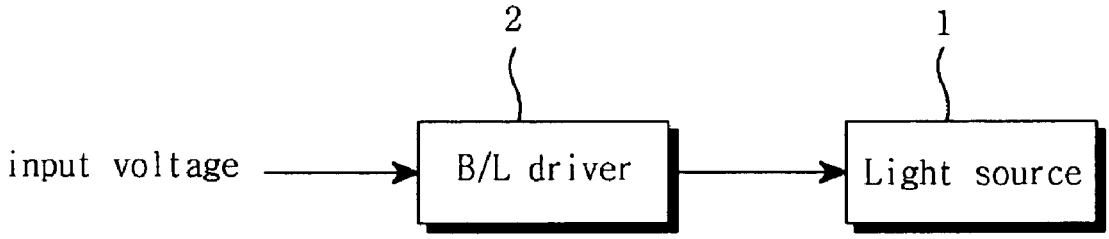
Fig.1 (Related Art)
FIG. 1 is a block diagram of a backlight driving apparatus for an LCD device according to the related art.
Figure 2:
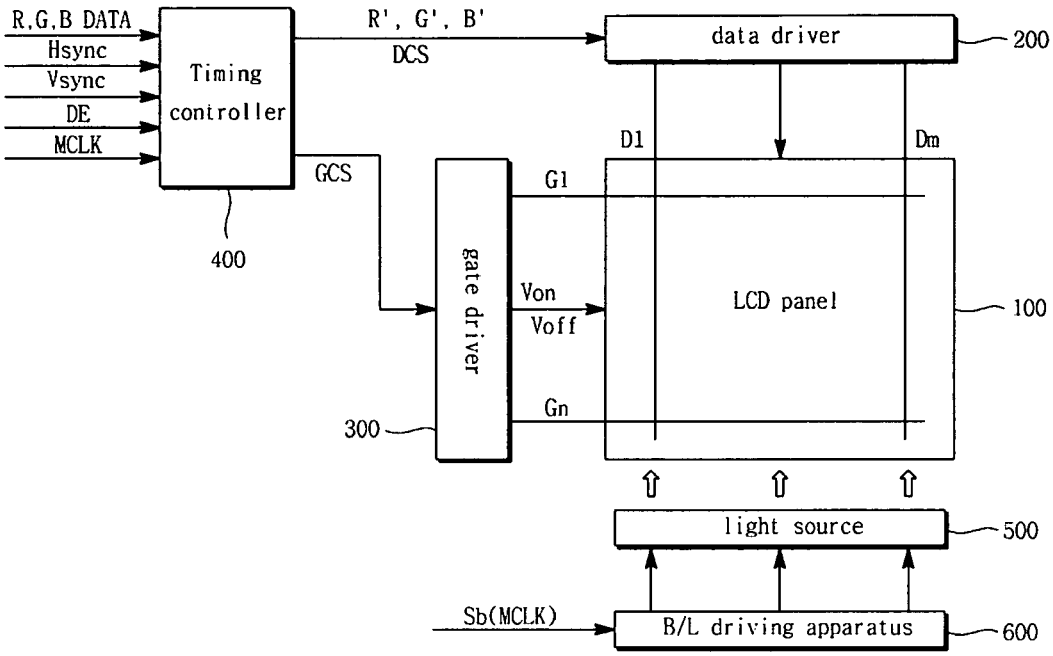
FIG. 2 shows a schematic diagram of a backlight apparatus for a liquid crystal display device according to an embodiment of the present invention.

FIG. 2 shows a schematic diagram of a backlight apparatus for a liquid crystal display device according to an embodiment of the present invention. Referring to FIG. 2, an LCD device includes an LCD panel 100 for displaying an image thereon, a data driver 200 for driving data lines D1, . . . , Dm of the LCD panel 100, a gate driver 300 for driving gate lines G1, . . . , Gn of the LCD panel 100, a timing controller 400 for applying control signals to the data driver 200 and the gate driver 300, a plurality of light sources 500 for supplying light to the LCD panel 100, and a backlight (B/L) driving apparatus 600 for driving the plurality of light sources 500.

The timing controller 400 receives digital picture signals R, G and B DATA, a horizontal sync signal Hsync, a vertical sync signal Vsync, an enable signal DE and a main clock MCLK externally provided, and supplies control signals DCS and GCS to the data driver 200 and the gate driver 300, respectively. Furthermore, the timing controller 400 transforms the externally input digital picture signals R, G and B DATA and supplies the transformed digital picture signals R', G' and B' to the data driver 200.

The enable signal DE is a signal indicating a time period when data are output to the timing controller, and the main clock MCLK is a reference clock signal, which may be received from a microprocessor.

The gate driver 300 applies a gate-off voltage Voff or a gate-on voltage Von to the gate lines G1 to Gn according to the gate control signal GCS from the timing controller 400, thus supplies scan signals that are sequentially shifted to the gate lines G1 to Gn. The data driver 200 generates analog gray level voltages corresponding to the digital picture signals R', G' and B' in response to the control signal DCS from the timing controller 400. When the gate lines G1, . . . , Gn are turned on in response to the gate control signal GCS, the data driver 200 applies the analog gray level voltages to the data lines D1, . . . , Dm of the LCD panel 100.

The plurality of light sources 500 are disposed at the rear of the LCD panel 100 and supplies light to the LCD panel 100. At least one light source 500 is provided to increase the luminance of the LCD panel 100. The light sources 500 are driven by a current from the backlight driving apparatus 600, and stably operate following application of a high voltage across each of the light sources 500. Each of the plurality of light sources 500 includes one of a CCFL, a EEFL and a LED. When the light sources 500 are LEDs, they are driven by DC rather than AC power. This will be described in detail later on.

The backlight driving apparatus 600 receives a light source control signal Sb, for example, from an external microprocessor. The backlight driving apparatus 600 controls the lighting of the plurality of light sources 500, and supplies a high voltage required for the turning on the plurality of light sources 500. The light source control signal Sb is generated through the main clock MCLK independently from the control signals DCS and GCS output from the timing controller 400.

For reference, the backlight driving apparatus 600 according to an embodiment of the present invention may have a DC or AC driving type depending on the type of a light source. Accordingly, examples of a fluorescent lamp in which the light source is the AC driving type and the LED in which the light source is the DC driving type will be described.

Figure 3A:
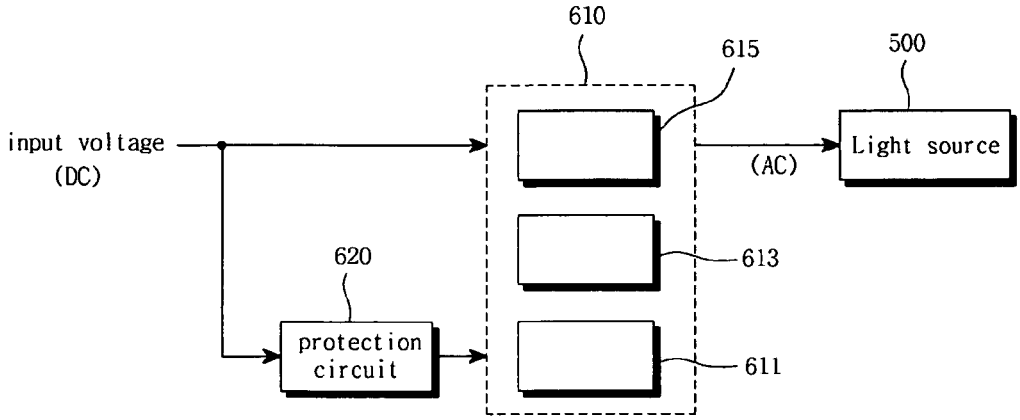
FIG. 3*a* shows a schematic diagram of a first exemplary backlight driving apparatus for the liquid crystal display according to an embodiment of the present invention.

FIG. 3*a* shows a schematic diagram of a first exemplary backlight driving apparatus for the liquid crystal display according to an embodiment of the present invention. Referring to FIG. 3*a*, the backlight driving apparatus of the liquid crystal display includes the light source 500 that emits light, an AC driver 610 for supplying constant AC power to the light source 500, and a protection circuit 620 electrically connected to the AC driver 610, for precluding an excess current from being applied to the AC driver 610. In the AC driving method, a DC input voltage applied from an external power source is transformed into and boosted to an AC voltage through the AC driver 610, and AC power of a constant high voltage is supplied to the light source 500, so that light is emitted. In this case, an excess current may flow through the AC driver 610 due to shift in the input voltage. The protection circuit 620 serves to compare and determine the excess current and prevent the excess current from flowing through the AC driver 610.

For example, the light source 500 may be either CCFL or EEFL depending on the AC voltage. The AC driver 610 transforms the DC input voltage into a high AC voltage and supplies the transformed voltage to the light source 500. The AC driver 610 may include a DC/DC converter 611 for transforming a DC input voltage into a DC voltage of a predetermined level to stabilize the input voltage, a DC/AC converter 613 for transforming the DC voltage from the DC/DC converter 611 into an AC voltage, and a transformer 615 for boosting the AC voltage from the DC/AC converter 613 to a predetermined level. It is, however, to be noted that an embodiment of the present invention is not limited to the above construction.

The protection circuit 620 is electrically connected to an input terminal of the AC driver 610. The protection circuit 620 determines whether an input voltage applied to the AC driver 610 is lower than a predetermined voltage and outputs a control voltage for the driving of the AC driver 610, thereby protecting the circuits of the AC driver 610.

Figure 3B:
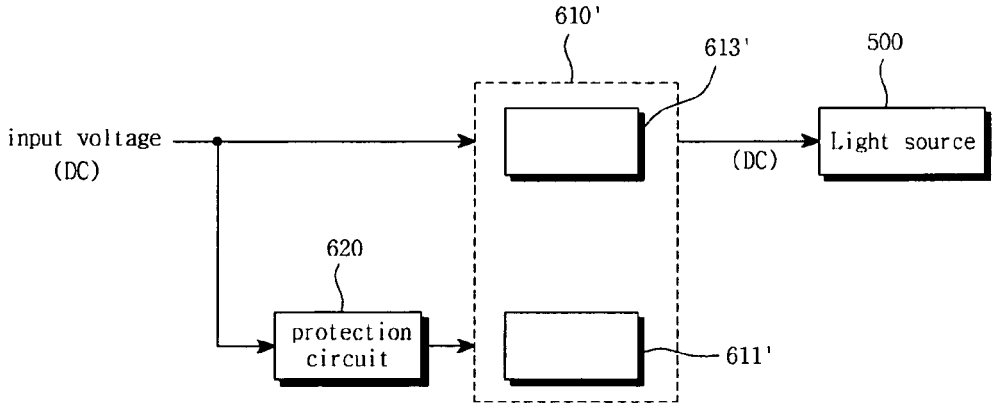
FIG. 3*b* shows a schematic diagram of a second exemplary backlight driving apparatus for the liquid crystal display according to another embodiment of the present invention.

FIG. 3*b* shows a schematic diagram of a second exemplary backlight driving apparatus for the liquid crystal display according to another embodiment of the present invention. Referring to FIG. 3*b*, the backlight driving apparatus includes the light source 500 that emits light, a DC driver 610' for supplying constant DC power to the light source 500, and a protection circuit 620 electrically connected to the DC driver 610', for preventing an excess current from being applied to the DC driver 610'.

In the DC driving type, for example, employing an LED as the light source 500, a DC input voltage from an external power source is transformed into and boosted to a DC voltage of a predetermined level, and the boosted DC voltage is applied across the light source 500, thereby emitting light. At this time, an excess current may flow through the DC driver 610' due to shift in the input voltage. The protection circuit 620 determines the excess current and prevent it from flowing through the DC driver 610'.

The DC driver 610' may include a pulse width modulation (PWM) signal providing unit 611' for transforming the DC input voltage received from the external power source into a PWM signal, and a static voltage providing unit 613' for boosting the PWM signal from the PWM signal providing unit 610' to a predetermined level and providing a static voltage to the light source 500. It is, however, to be noted that an embodiment of the present invention is not limited thereto. Moreover, the same reference numerals from FIG. 3*b* will designate the same elements as those of the backlight driving apparatus of FIG. 3*a* and, therefore, will not be further described.

Figure 4:
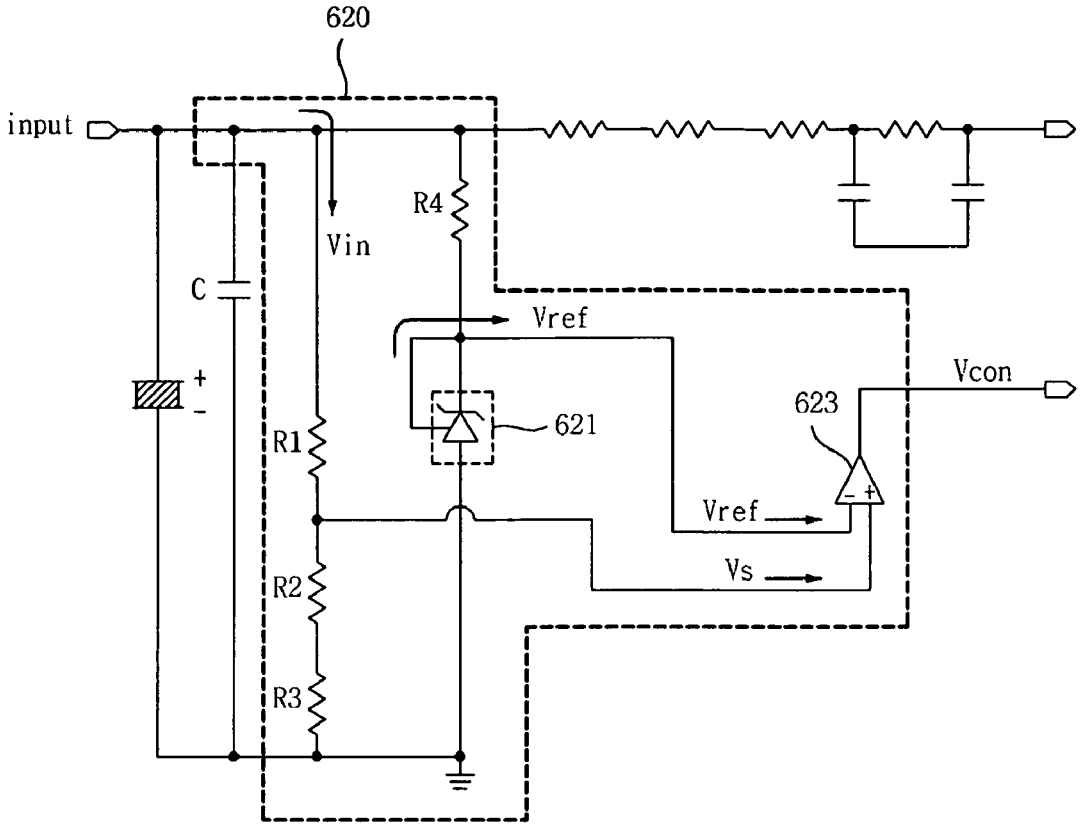
FIG. 4 shows a circuit diagram of an exemplary protection circuit for a backlight driving apparatus according to an embodiment of the present invention.

FIG. 4 shows a circuit diagram of an exemplary protection circuit for a backlight driving apparatus according to an embodiment of the present invention. Referring to FIG. 4, the protection circuit 620 includes a reference voltage setting unit 621 for setting a reference voltage Vref of a predetermined level, one or more resistors R1, R2, and R3 for dividing an input voltage Vin and forming a comparison voltage Vs, and a comparator 623 for comparing the reference voltage Vref of the reference voltage setting unit 621 and the comparison voltage Vs and outputting a control voltage Vcon, as shown in FIG. 4.

The first resistor R1, the second resistor R2 and the third resistor R3 are connected in series with each other and in parallel between the input terminal input of the AC driver 610 and a ground. The series connection of the resistors R1, R2, and R3 performs a voltage division of the input voltage Vin applied to the input terminal according to the respective resistances of resistors R1, R2 and R3. Furthermore, a fourth resistor R4 is connected in parallel to the first, second and third resistors R1, R2, and R3 and is connected in series to the reference voltage setting unit 621.

The reference voltage setting unit 621 may be a zener diode for making a constant voltage although a current is varied due to shift in a load, etc. If an instantly high voltage is applied, the zener diode generates a zener breakdown voltage. Accordingly, a voltage higher than the zener breakdown voltage is not applied and a constant static voltage can be output. The static voltage becomes the reference voltage Vref, which will become a basis for comparison for the input voltage Vin.

The comparator 623 may be a two-stage device. The comparator 623 may have two input terminals electrically connected to the output terminal of the reference voltage setting unit 621 and a node between the first and second resistors R1 and R2, respectively, and an output terminal connected to the DC/AC converter 613 of the AC driver 610. The comparator 623 generally consists of an operational amplifier, as shown in FIG. 4, but is not limited thereto.

Accordingly, the comparator 623 compares the reference voltage Vref from the reference voltage setting unit 621 and the comparison voltage Vs through the first resistor R1, and transfers the corresponding control voltage Vcon of a high or low level to the DC/AC converter 613 through its output terminal. The comparison voltage Vs has a value lower than the input voltage Vin.

Figure 5:
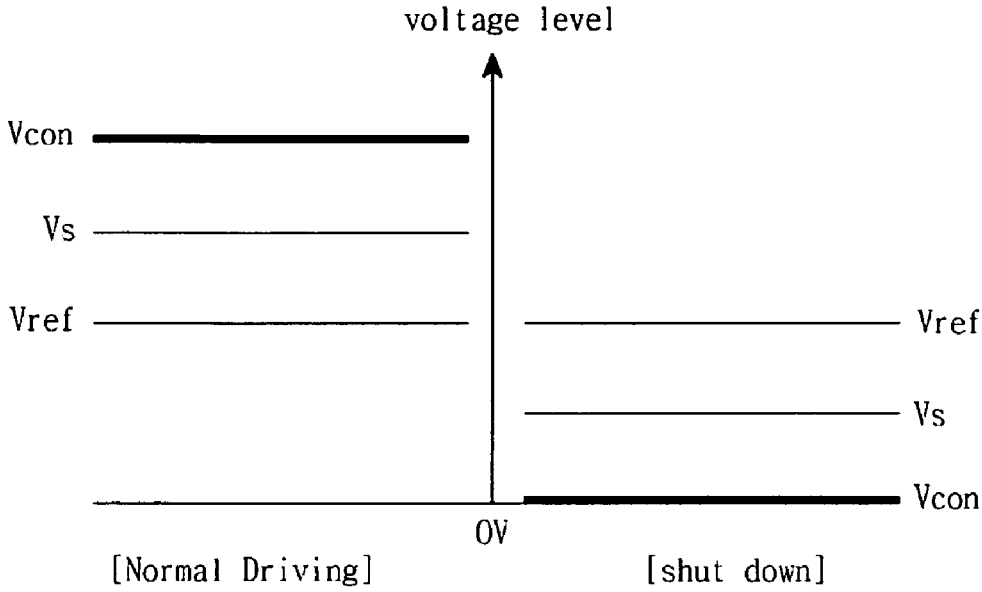
FIG. 5 illustrates the operation of the protection circuit of FIG. 4.

FIG. 5 illustrates the operation of the protection circuit of FIG. 4. Referring to FIG. 5, if the externally provided input voltage Vin is received as shown in FIG. 4, the reference voltage setting unit 621 of the protection circuit 620 generates a constant reference voltage Vref according to an instantly high voltage and outputs it to the comparator 623.

Furthermore, the first, second, and third resistors R1, R2, and R3 that are connected in series divide the input voltage Vin received through the input terminal, and generate the comparison voltage Vs lower than the input voltage Vin. This is for the purpose of lowering a high input voltage to stably drive the circuit.

The protection circuit 620 according to an embodiment of the present invention transfers the input voltage Vin through the first resistor R1 to the comparator 623 as the comparison voltage Vs.

The comparator 623 compares the reference voltage Vref from the reference voltage setting unit 621 and the comparison voltage Vs through the first resistor R1 and outputs the control voltage Vcon accordingly. Thus, if comparison is performed on the basis of the reference voltage Vref as shown in FIG. 5, when the comparison voltage Vs is higher than the reference voltage Vref, the comparator 623 outputs the control voltage Vcon as a high level to drive the driver 610 in a normal state. However, when the comparison voltage Vs is lower than the reference voltage Vref, the comparator 623 outputs the control voltage Vcon as a low level to shut down the driving of the AC driver 610. The control voltage Vcon outputted as a high level may be higher than the comparison voltage Vs. The control voltage Vcon output as the low level may be lower than the comparison voltage Vs or may be a ground voltage 0V.

Figure 6:
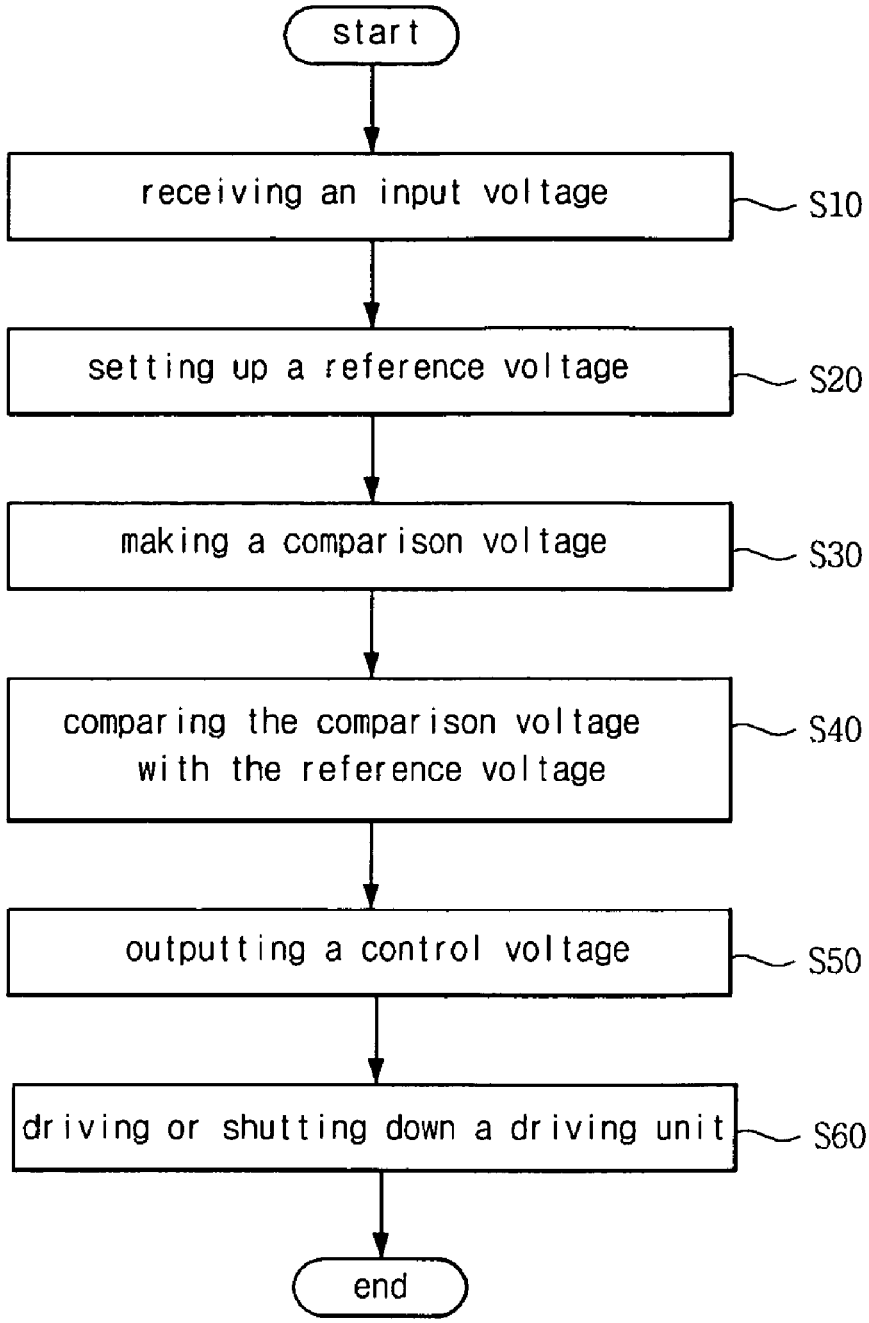
FIG. 6 is a flowchart illustrating a method for driving the backlight driving apparatus according to an embodiment of the present invention.

FIG. 6 is a flowchart illustrating a method for driving the backlight driving apparatus according to an embodiment of the present invention. Referring to FIG. 6, the backlight driving apparatus receives the externally provided input voltage Vin through the driver for driving the light source at step S10. The driver is classified into the DC driver type and the AC driver type depending on the type of a light source as described above. The light source may include one of a CCFL and an EEFL that are driven with an AC voltage, and the LED that is driven with a DC voltage.

The protection circuit connected to a previous stage of the driver sets the reference voltage Vref, divides the input voltage Vin and forms the comparison voltage Vs at steps S20 and S30. The reference voltage Vref may be implemented through a zener diode. The comparison voltage Vs may be implemented through one or more resistors R1, R2, and R3 that are connected in series.

The comparison voltage Vs is then compared with a preset reference voltage Vref at step S40.

After the comparison, the control voltage Vcon is output to drive or shut down the operation of the driver at steps S50 and S60.

In the above steps S40 to S60, the method for comparing the comparison voltage Vs and the reference voltage Vref and outputting the control voltage Vcon is the same as that described with reference to the operation of the protection circuit 620.

In accordance with an embodiment of the present invention, if a physical property of the LCD device or a backlight unit is changed or the input voltage Vin drops below the – reference voltage Vref due to the instability of input power, it is detected through the protection circuit 620 and the driver is immediately shut down. It is therefore possible to effectively protect the driver from an excess current.

In accordance with an embodiment of the invention, an input voltage applied to the driver is compared with a preset reference voltage, and an excess current is shut down to prevent it from flowing through the driver. Accordingly, circuit damages due to an excessive current flow can be prevented and the driver can be always driven stably. Accordingly, the reliability of the LCD device is improved.

It will be apparent to those skilled in the art that various modifications and variations can be made in embodiments of the present invention. Thus, it is intended that embodiments of the present invention cover the modifications and variations of the embodiments described herein provided they come within the scope of the appended claims and their equivalents.

What is claimed is:

1. A backlight driving apparatus of a liquid crystal display, comprising:

a light source that emits light;

an AC driver for supplying AC power of a high voltage so that the light source emits light; and a protection circuit electrically connected to the AC driver, for determining whether an input voltage applied to the AC driver is lower than a predetermined voltage and stopping the driving of the AC driver, wherein the protection circuit comprises:

a reference voltage setting unit for setting a reference voltage of a predetermined level;

one or more resistors for dividing the input voltage applied to the AC driver in order to form a comparison voltage; and a comparator having two input terminals connected to an output terminal of the reference voltage setting unit and the one or more resistors, respectively, wherein the comparator compares the reference voltage and the comparison voltage received via the one or more resistors and outputs a control voltage for the driving of the AC driver.

2. The backlight driving apparatus of claim 1, wherein the reference voltage setting unit comprises a zener diode.

3. The backlight driving apparatus of claim 1, wherein when the comparison voltage is higher than the reference voltage, the comparator outputs the control voltage as a high level and drives the AC driver in a normal state.

4. The backlight driving apparatus of claim 3, wherein the control voltage is higher than the comparison voltage.

5. The backlight driving apparatus of claim 1, wherein when the comparison voltage is lower than the reference voltage, the comparator outputs the control voltage as a low level and shuts down the AC driver.

6. The backlight driving apparatus of claim 5, wherein the control voltage is lower than the comparison voltage.

7. The backlight driving apparatus of claim 5, wherein the control voltage is a ground voltage.

8. The backlight driving apparatus of claim 1, wherein the comparator is an operational amplifier.

9. The backlight driving apparatus of claim 1, wherein the AC driver comprises:

a DC/AC converter for converting a DC input voltage into an AC voltage; and a transformer for boosting the AC voltage converted through the DC/AC converter to a predetermined level.

10. The backlight driving apparatus of claim 1, wherein the light source is a Cold Cathode Fluorescent Lamp (EEFL).

11. The backlight driving apparatus of claim 1, wherein the light source is an External Electrode Fluorescent Lamp (EEFL).

12. A backlight driving apparatus of a liquid crystal display, comprising:

a light-emitting diode (LED) that emits light;

a DC driver for supplying DC power of a high voltage so that the LED emits light; and a protection circuit electrically connected to the DC driver, for determining whether an input voltage applied to the DC driver is lower than a predetermined voltage and stopping the driving of the DC driver, wherein the protection circuit comprises:

a reference voltage setting unit for setting a reference voltage of a predetermined level;

one or more resistors for dividing the input voltage applied to the DC driver in order to form a comparison voltage; and a comparator having two input terminals connected to an output terminal of the reference voltage setting unit and the one or more resistors, respectively, wherein the comparator compares the reference voltage and the comparison voltage received via the one or more resistors and outputs a control voltage for the driving of the DC driver.

13. The backlight driving apparatus of claim 12, wherein the reference voltage setting unit comprises a zener diode.

14. The backlight driving apparatus of claim 12, wherein when the comparison voltage is higher than the reference voltage, the comparator outputs the control voltage as a high level and drives the DC driver in a normal state.

15. The backlight driving apparatus of claim 14, wherein the control voltage is higher than the comparison voltage.

16. The backlight driving apparatus of claim 12, wherein when the comparison voltage is lower than the reference voltage, the comparator outputs the control voltage as a low level and shuts down the DC driver.

17. The backlight driving apparatus of claim 16, wherein the control voltage is lower than the comparison voltage.

18. The backlight driving apparatus of claim 16, wherein the control voltage is a ground voltage.

19. The backlight driving apparatus of claim 12, wherein the comparator is an operational amplifier.

20. The backlight driving apparatus of claim 12, wherein the DC driver comprises:

a pulse width modulation signal providing unit for transforming a DC input voltage into a pulse width modulation signal and outputting the transformed pulse width modulation signal; and a static voltage providing unit for transforming the transformed pulse width modulation signal into a constant level and sproviding the transformed signal.

* * * * *